United States Patent [19]

Iwai

[11] Patent Number: 4,618,278

[45] Date of Patent: Oct. 21, 1986

[54] PAPER FEED CONTROL IN A PRINTER

[75] Inventor: Hiroji Iwai, Yamatokoriyama, Japan

[73] Assignee: Sharp Kabushiki Kaisha, Osaka, Japan

[21] Appl. No.: 697,878

[22] Filed: Feb. 4, 1985

[30] Foreign Application Priority Data

Feb. 15, 1984 [JP] Japan ..... 59-20706[U]

[51] Int. Cl.[4] ..... B41J 19/92

[52] U.S. Cl. ..... 400/568; 400/902; 318/685

[58] Field of Search ..... 318/685; 400/568, 902, 400/569, 911

[56] References Cited

U.S. PATENT DOCUMENTS

| | | | |
|---|---|---|---|
| 3,849,715 | 11/1974 | Irisson et al. | 318/685 |
| 3,880,016 | 4/1975 | Jamieson et al. | 400/902 |
| 4,347,006 | 8/1982 | Shakib | 400/569 |

FOREIGN PATENT DOCUMENTS

| | | | |
|---|---|---|---|
| 2658904 | 7/1978 | Fed. Rep. of Germany | 400/902 |
| 2943493 | 8/1980 | Fed. Rep. of Germany | 400/568 |
| 42842 | 3/1980 | Japan | 400/902 |
| 34479 | 4/1981 | Japan | 400/568 |
| 140178 | 8/1982 | Japan | 400/568 |
| 167280 | 10/1982 | Japan | 400/568 |

OTHER PUBLICATIONS

Gilstad, "Position Reset . . . Position Drives", IBM Technical Disclosure Bulletin, vol. 24, No. 10, pp. 4924–4925, 3–82.

Heath, "Adapter for . . . Space Control", IBM Technical Disclosure Bulletin, vol. 19, No. 5, pp. 1539–1541, 10–76.

*Primary Examiner*—William Pieprz

*Attorney, Agent, or Firm*—Birch, Stewart, Kolasch & Birch

[57] ABSTRACT

A paper feed control system in a printer allows two types of manual paper feed operation. In a first type of manual paper feed operation, a course manual paper feed is conducted while an electrical detent operation is conducted by a paper feed drive pulse motor. In a second type of manual paper feed operation, a fine adjustment of the paper position is carried out while the electrical detent operation is precluded. A counter system is associated with the rotation of the paper feed drive pulse motor so as to provide the electrical detent operation at preselected positions. When the second type of manual paper feed operation is completed, the counter system is reset so that the subsequent electrical detent operation is carried out with reference to the finely adjusted paper position.

2 Claims, 9 Drawing Figures

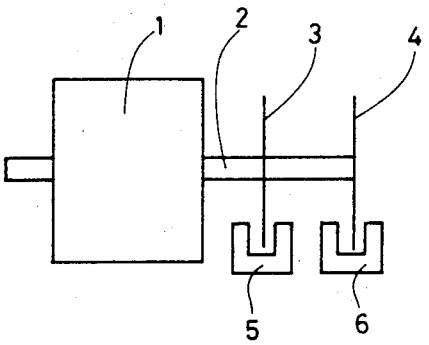
FIG. 3
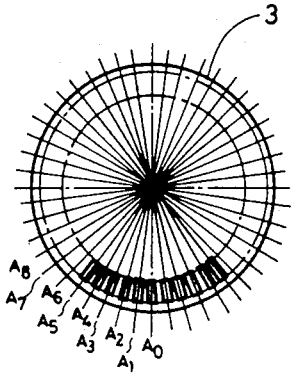
FIG.4
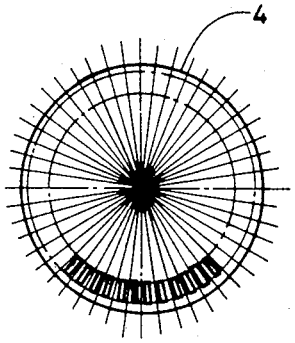
FIG.5
FIG. 6(A) $S_1$
FIG. 6(B) $S_2$
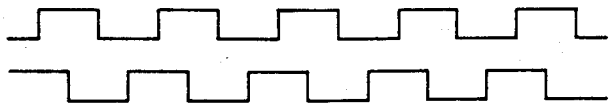

PAPER FEED CONTROL IN A PRINTER

BACKGROUND OF THE INVENTION

1. Field of the Invention

The present invention relates to a paper feed control system in a printer such as a typewriter and, more particularly, to a manual fine feed control system which ensures a fine feed in a manual paper feed mode of operation without a complicated mechanical structure.

2. Description of the Prior Art

A paper feed system in a printer, especially a typewriter, generally includes a platen for supporting a recording paper sheet. The platen is mechanically connected to a paper feed drive motor such as a pulse motor via a transmission gear mechanism. The platen is driven to rotate by the paper feed drive motor so that the recording paper sheet mounted on the platen is fed forward or backward (reverse) to position the recording paper sheet at a desired position.

In such a paper feed system, a manual paper adjusting is often conducted before or between the automatic paper feed operation. In the manual paper feed operation, the platen is manually rotated to precisely locate the recording paper sheet at a desired position. On the other hand, an electrical detent operation is conducted to determine the paper sheet position in the automatic paper feed operation. In the conventional system, the above-mentioned manual paper feed operation is not properly correlated with the electrical detent operation in the automatic paper feed operation and, therefore, an accurate paper sheet positioning is not ensured if a manual paper adjusting is conducted before the automatic paper feed operation.

OBJECTS AND SUMMARY OF THE INVENTION

1. Objects of the Invention

Accordingly, an object of the present invention is to provide a novel paper feed control system in a printer such as a typewriter.

Another object of the present invention is to provide a paper feed control system in a printer which ensures a fine adjustment of the paper sheet without a complicated mechanical structure.

Still another object of the present invention is to provide a paper feed control system in a printer which ensures a fine adjustment of the paper sheet location in a manual paper feed mode of operation without requiring a clutch mechanism in a platen drive mechanism.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

2. Summary of the Invention

To achieve the above objects, pursuant to an embodiment of the present invention, a platen is mechanically connected to a drive motor such as a pulse motor via a transmission gear mechanism which does not include a clutch mechanism. A manual rotation knob is secured to a shaft of the platen to allow the manual rotation of the platen in the manual paper feed operation and the manual fine adjustment operation. A rotary position detection unit is secured to a shaft of the pulse motor so as to develop a pulse signal in response to the rotation of the pulse motor. A counter receives the pulse signal developed from the rotary position detection unit so that an electrical detent operation is carried out to hold the pulse motor at a desired position in accordance with the contents stored in the counter. In the manual fine adjustment operation, a detection device detects the mode of operation and resets the counter. That is, the counter is reset when the manual fine adjustment operation is completed. The subsequent automatic paper position control is carried out with reference to the contents of the counter.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 3 is a schematic sectional view of an essential part of an embodiment of a paper feed control system of the present invention;

FIG. 4 is a front view of a slit plate included in the paper feed control system of FIG. 3;

FIG. 5 is a front view of another slit plate included in the paper feed control system of FIG. 3;

FIGS. 6(A) and 6(B) are waveform charts showing pulse signals developed from photocouplers associated with the slit plates of FIGS. 4 and 5, respectively;

DESCRIPTION OF THE PREFERRED EMBODIMENTS

A paper feed system in a printer generally includes a four-phase pulse motor which is driven in a four step manner ($A \rightarrow B \rightarrow \overline{A} \rightarrow \overline{B} \rightarrow A$) to minimize the phase deviation. The four step cycle corresponds to the minimum paper feed amount (feed unit), and the minimum paper feed amount is normally 1/48" (inches). The automatic paper feed operation is based on this four phase control.

In a printer, especially a typewriter, a manual paper feed operation is carried out in addition to the automatic paper feed operation. There are two types of the manual paper feed operation. In the first type of manual paper feed operation, a platen is manually rotated through the use of a knob secured to a shaft of the platen while the platen is mechanically connected to a shaft of the paper feed drive motor(pulse motor) via a clutch mechanism. In this first type of the manual paper feed operation, an electrical detent force is generally operated in the paper feed drive motor (pulse motor). The detent unit is normally N times the above-mentioned minimum paper feed amount (1/48"). For example, the electrical detent is carried out in the unit of 1/12" (inches), where N is four (4). The N should be greater than or equal to four (4) to effectively conduct the first type of the manual paper feed operation. The detent operation of 1/12" unit is carried out through the use of a rotation detection pulse signal, which is developed when the shaft of the pulse motor rotates by 1/48", and a 4-nary counter, which counts the rotation detection pulse signal. That is, the electrical detent operation is conducted in accordance with the contents stored in the 4-nary counter.

In the second type of manual paper feed operation, a fine adjustment of the paper sheet position is carried out by manually rotating the knob while the platen is mechanically disconnected from the paper feed drive motor (pulse motor) through the use of the clutch mechanism. The fine adjustment is normally conducted in the order smaller than the above-mentioned detent unit of 1/12". Accordingly, if the platen is mechanically connected to the paper feed drive motor (pulse motor) even during the second type of the manual paper feed operation, the above-mentioned 4-nary counter conducts the count operation, and the subsequent detent operation can not be properly carried out. Therefore, in the second type of the manual paper feed operation, the platen must be mechanically disconnected from the paper feed drive motor through the use of the clutch mechanism in the conventional system.

Figure 1:
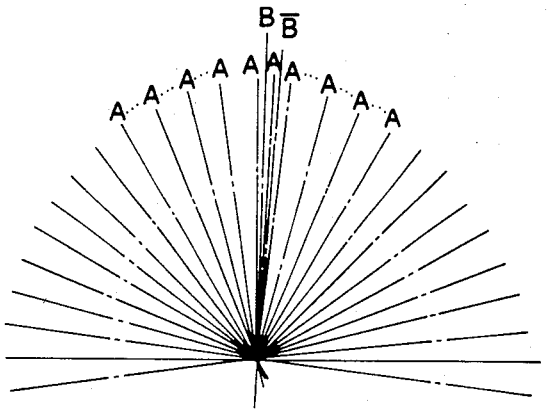
FIG. 1 is a schematic chart for explaining a motor shaft rotating position in an embodiment of a paper feed control system of the present invention.
Figure 2:
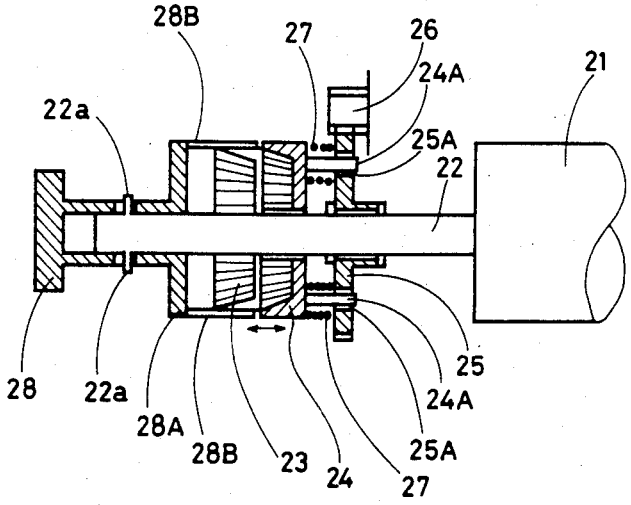
FIG.2 PRIOR ART
FIG. 2 is a sectional view of an essential part of the a paper feed system of prior art.

FIG. 2 shows the clutch mechanism of a conventional system. A rotation shaft 22 of a platen 21 is extended to which a clutch mechanism including clutch gears 23 and 24 is secured. The clutch gear 23 is tightly secured to the rotation shaft 22 and the clutch gear 24 is slidably secured to the rotation shaft 22 so that the clutch gear 24 is slidable in the shaft direction along the rotation shaft 22. A pair of engaging projections 24A are fixed to the clutch gear 24 in a manner that the pair of projections 24A project toward the platen 21. A transmission gear 25 is rotatably secured to the rotation shaft 22 at a position between the clutch gear 24 and the platen 21. The transmission gear 25 is mechanically connected to the shaft of the paper feed drive motor (pulse motor) via an intermediate gear 26. A pair of holes 25A are formed in the transmission gear 25, to which the pair of engaging projections 24A are inserted so that the clutch gear 24 and the transmission gear 25 rotate in unison. Springs 27 are disposed between the transmission gear 25 and the clutch gear 24 so that the clutch gear 24 is depressed toward the clutch gear 23, whereby the clutch gears 23 and 24 are geared to each other in the normal mode of operation. Accordingly, in the normal mode of operation, the motor rotation is transferred to the rotation shaft 22 via the intermediate gear 26, the transmission gear 25, and the clutch gears 24 and 23. The platen 21 rotates when the rotation shaft 22 rotates.

A manual rotation knob 28 is secured at the end of the rotation shaft 22 in a manner that the manual rotation knob 28 is engaged by a pair of projections **22*a* which are secured to the rotation shaft 22, in the rotating direction, and the manual rotation knob 28 is slidable in the shaft direction by a predetermined distance. The manual rotation knob 28 integrally includes a circular plate portion 28A of which a diameter is slightly longer than that of the clutch gear 23. A pair of projecting rods 28B are fixed to the circular plate portion 28A so that the pair of the projecting rods 28B confront the periphery of the clutch gear 24**.

In the first type of the manual paper feed operation, the manual rotation knob 28 is manually rotated to rotate the platen 21 via the rotation shaft 22 without disconnecting the clutch mechanism. That is, in the first type of the manual paper feed operation, the rotation of the manual rotation knob 28 is transferred to the paper feed drive motor via the clutch gears 23 and 24, the transmission gear 25 and the intermediate gear 26. In the second type of the manual paper feed operation, namely in the manual fine adjustment mode, the manual rotation knob 28 is depressed toward the platen 21. The pair of projecting rods 28B depress the clutch gear 24 against the springs 27 so that the clutch gear 23 is mechanically disconnected from the clutch gear 24. That is, the manual rotation knob 28 is manually rotated under the condition where the clutch mechanism is disconnected. The platen 21 is positioned at a desired rotation condition because the rotation of the platen 21 is free from the paper feed drive motor in the second type of the manual paper feed operation.

In the conventional paper feed control system, the platen 21 is mechanically connected to the paper feed drive motor via the clutch mechanism, the transmission gear 25, and the intermediate gear 26. The looseness included in the pair of engaging projections 24A and the pair of holes 25A precludes an accurate positioning operation. Further, the clutch mechanism is complicated.

The present invention is to provide a paper feed control system which does not include a clutch mechanism, and ensures an accurate positioning of a record receiving paper even when a manual fine adjustment is conducted before the automatic paper feed operation is conducted.

FIG. 3 schematically shows a paper feed drive motor portion in an embodiment of a paper feed control system of the present invention. Two slit plates 3 and 4 are secured to a rotation shaft 2 of a paper feed drive motor (pulse motor) 1. A photocoupler 5 is provided for detecting slits formed in the slit plate 3, and a photocoupler 6 is provided for detecting slits formed in the slit plate 4. The slit plate 3 includes slits formed therein as shown in FIG. 4. The slit plate 4 includes slits formed therein as shown in FIG. 5. The slit plates 3 and 4 are secured to the rotation shaft 2 of the paper feed drive motor (pulse motor) 1 in a manner that the slits of the slit plate 4 have a phase difference from that of the slit plate 3 by 90 degrees. FIG. 6(A) shows a pulse signal $S_1$ developed from the photocoupler 5, and FIG. 6(B) shows a pulse signal $S_2$ developed from the photocoupler 6 when the rotation shaft 2 rotates. The pulse signal $S_1$ has a phase difference from that of the pulse signal $S_2$ by 90 degrees.

The slits of the slit plates 3 and 4 are formed at an interval corresponding to the four pulse length (the minimum paper feed amount: 1/48") of the paper feed drive motor (pulse motor) 1. The electrical detent operation in the first type of manual paper feed operation is carried out in the unit of 1/12", namely, four times the minimum paper feed amount. More specifically, when the first type of manual paper feed operation is carried out under the condition where the electrical detent is performed at the position $A_O$ in FIG. 4, the next detent positions are $A_4$, $A_8$, ---- in FIG. 4. The detent operation is carried out through the use of a 4-nary counter which receives the pulse signal $S_1$ developed from the photocoupler 5. The second slit plate 4 is provided for detecting the rotating direction of the rotation shaft 2.

Figure 7:
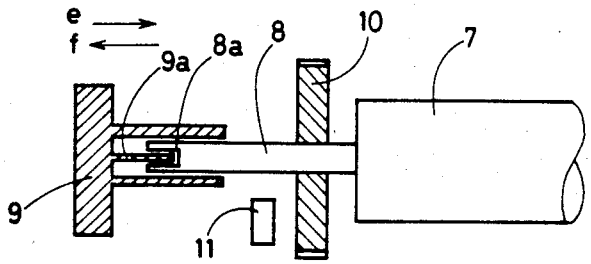
FIG. 7 is a sectional view of another essential part of the embodiment of the paper feed control system of the present invention.

FIG. 7 shows a platen portion in the embodiment of the paper feed control system of the present invention. A rotation shaft 8 of a platen 7 is extended, to which a manual rotation knob 9 is secured. The manual rotation knob 9 is tightly secured to the rotation shaft 8 in the rotating direction through the use of an engaging projection 9*a* fixed to the manual rotation knob 9 and an engaging indent 8*a* formed at the end of the rotation shaft 8. Further, the manual rotation knob 9 is slidable in the shaft direction of the rotation shaft 8 by a predetermined distance. When the manual rotation knob 9 is manually rotated, the platen 7 is driven to rotate via the rotation shaft 8. A transmission gear 10 is tightly secured to the rotation shaft 8 at a position between the platen 7 and the manual rotation knob 9. The transmission gear 10 is mechanically connected to the paper feed drive motor (pulse motor) 1 via an intermediate gear (not shown).

A switch 11 is provided to detect the slide movement of the manual rotation knob 9 along the rotation shaft 8. That is, the switch 11 is switched on when the manual rotation knob 9 is pushed in the direction shown by an arrow e for the purpose of the fine adjustment. That is, the switch 11 is switched on when the second type of manual paper feed operation is conducted. The switch is in the off state in the normal mode of the operation and in the first type of manual paper feed operation, where the manual rotation knob 9 is pushed in the direction shown by an arrow f.

Figure 8:
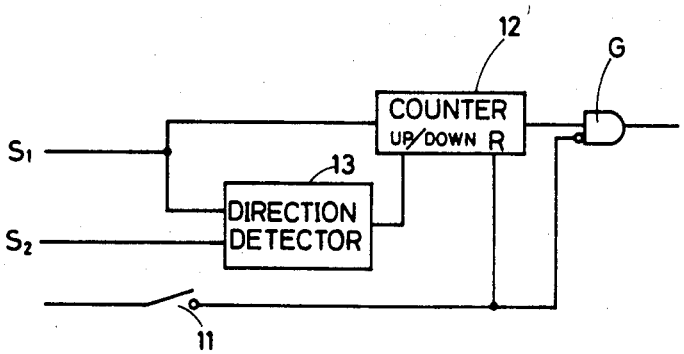
FIG. 8 is a block diagram of a control circuit of the embodiment of the paper feed control system of the present invention.

FIG. 8 shows a portion of a control circuit of the embodiment of the paper feed control system of the present invention. The pulse signals $S_1$ and $S_2$ developed from the photocouplers 5 and 6, respectively, and the switching signal of the switch 11 are introduced into the control circuit. The pulse signal $S_1$ associated with the first slit plate 3 is introduced into a count input terminal of a 4-nary up/down counter 12. The 4-nary counter 12 performs the count operation so as to develop a position control signal via a gate G in order to conduct the electrical detent operation at the positions, for example, $A_0$, $A_4$, $A_8$, ---- in the first type of manual paper feed operation. The pulse signal $S_1$ associated with the first slit plate 3 and the pulse signal $S_2$ associated with the second slit plate 4 are introduced into a direction detector 13 so as to detect the rotating direction of the rotation shaft 2. An output signal of the direction detector 13 is introduced into an up/down selection terminal of the 4-nary counter 12. More specifically, the 4-nary counter 12 functions as an up counter when the rotation shaft 2 rotates in the clockwise direction, and functions as a down counter when the rotation shaft 2 rotates in the counter-clockwise direction. The switching signal developed from the switch 11 is introduced into a reset terminal of the 4-nary up/down counter 12. Further, the switching signal of the switch 11 is applied to the gate G via an inverter so as to inhibit the gate G, thereby precluding the electrical detent operation by the paper feed drive motor (pulse motor) 1 at a desired time.

When the first type of manual paper feed operation is conducted, the manual rotation knob 9 is pushed in the direction shown by the arrow f in FIG. 7 and, therefore, the switch 11 is in the off state. The 4-nary up/down counter 12 counts the pulse signal $S_1$ so as to perform the electrical detent operation at the positions, for example, $A_0$, $A_4$, $A_8$, ----. When the second type of manual paper feed operation is conducted, the manual rotation knob 9 is manually pushed in the direction shown by the arrow e in FIG. 7. The switch 11 is switched on to inhibit the gate G. That is, the electrical detent operation is not performed when the manual fine adjustment operation is conducted. This allows a fine adjustment of the paper position. When, for example, the paper position is manually adjusted, in the second type of manual paper feed mode, at the position $A_3$ of FIG. 4 and the manual rotation knob 9 is returned to the normal position (shifted in the direction shown by the arrow f) after the fine adjustment, the switch 11 returns to the normal off state. The 4-nary counter 12 is reset at the trailing edge of the switching signal of the switch 11. Thus, the electrical detent operation is first conducted at the position $A_3$ shown in FIG. 4. The subsequent detent operation in the first type of manual paper feed operation is conducted at the positions $A_7$, $A_{11}$, ----. That is, the electrical detent operation is conducted in the order of the 1/12" space measured from the finely adjusted position $A_3$.

In the foregoing embodiment, the reset operation of the counter 12 is performed through the use of the switch 11 which detects the slide movement of the manual rotation knob 9. However, the reset operation of the counter 12 may alternatively be performed by a specific key included in a keyboard panel of the printer.

The invention being thus described, it will be obvious that the same may be varied in many ways without departure from the spirit and scope of the invention, which is limited only by the following claims.

What is claimed is:

1. A paper feed control system in a printer comprising:

a paper feed drive pulse motor;

a platen which supports a record receiving paper sheet;

a transmission gear secured to a shaft of said platen, and mechanically connected to said paper feed drive pulse motor so as to transfer the rotation of said paper feed drive pulse motor to said platen;

a manual rotation knob secured to one end of said shaft of said platen so as to allow a manual rotation of said platen;

rotation position detection means associated with said paper feed drive pulse motor for developing a rotation pulse signal in response to the rotation of said paper feed drive pulse motor said detection means including two slit plates secured to a shaft of said paper feed drive pulses motor and corresponding photocouplers provided for detecting slits formed in said slit plates;

a counter which counts by the $N^{th}$ number which receives said rotation detection pulse signal developed from said rotation position detection means, and develops a control output when said pulse signal is counted to the $N^{th}$ number;

electrical detent means for conducting an electrical detent operation of said paper feed drive pulse motor in accordance with the contents stored in said counter; and reset means for resetting said counter before initiating an automatic paper feed operation wherein when said manual rotation knob is held at a first position, a first type of manual paper feed operation is permitted wherein said platen is manually rotated while said electrical detent means is in an operative condition, and when said manual knob is held in a second position a second type of manual paper feed operation is permitted wherein said electrical detent means is not in an operative condition so as to ensure a fine adjustment of the record receiving paper sheet on said platen.

2. The paper feed control system of claim 1, further including:

mode detection means for developing a first mode signal when said manual rotation knob is held at said first position, and developing a second mode signal when said manual rotation knob is held at said second position; and activating means for activating said reset means when said second mode signal first appears and then disappears.

* * * * *